United States Patent [19]

DeBruyn

[11] 4,015,367

[45] Apr. 5, 1977

[54] WINDOW SASH POSITIONER

[75] Inventor: William T. DeBruyn, Grand Rapids, Mich.

[73] Assignee: The Citation Companies, Inc., Grand Rapids, Mich.

[22] Filed: Dec. 11, 1975

[21] Appl. No.: 639,625

[52] U.S. Cl. ..... 49/451

[51] Int. Cl.[2] ..... E05D 13/08

[58] Field of Search ..... 49/414–423, 49/434–438, 449, 451

[56] References Cited

UNITED STATES PATENTS

| | | | |
|---|---|---|---|
| 2,492,896 | 12/1949 | Schwartzmann | 49/415 |
| 2,526,170 | 10/1950 | Steingruber | 49/417 |
| 2,673,113 | 3/1954 | Giordano | 49/417 |
| 3,501,867 | 3/1970 | Scott | 49/451 |

*Primary Examiner*—Peter M. Caun

*Attorney, Agent, or Firm*—Price, Heneveld, Huizenga & Cooper

[57] ABSTRACT

A window positioner adapted to hold a window in an open position includes a frictional engaging member having novel biasing means and bias releasing means whereby as the window is moved upwardly, the frictional force is minimized to allow ease of movement of the window. The frictional force is sufficient to maintain and hold the window in a desired open position. The positioner includes a pair of cooperative engaging members adapted to frictionally engage a rail formed on the window jamb. One of the members is movable relative to the other to shift toward and frictionally engage the rail when the window is in open position. The novel biasing means includes an elongated tapered channel formed in a housing supporting the members which operates to shift the engaging means toward and away from the rail with movement of the window sash between raised and lowered positions.

23 Claims, 9 Drawing Figures

WINDOW SASH POSITIONER

BACKGROUND OF THE INVENTION

The present invention relates to a window sash positioner or sash balance and more particularly to a self-releasing friction operating device.

A basic problem encountered with window sashes designed to be raised and lowered by sliding within vertical jamb channels is that the windows tend to stick if the window sash is fitted too tightly against the corresponding jamb. Conversely, if the window sash is fitted loosely within the window jamb, the window will not remain in a raised position. Frequently, thus, this type of window either cannot be easily raised and lowered or it can not reliably be positioned in a variety of stationary positions.

With the advent of aluminum and like metal window sashes and casings, various frictional devices have been developed and employed to avoid the use of pulley and bias spring arrangements which are costly and complex. Typically, however, such frictional devices have one predominant shortcoming, i.e., the friction has been a constant factor existing when the sash is both raised and lowered. The friction must have a magnitude such as to exceed the weight of the window itself in order to hold the window in any desired raised position. The resistance of the positioner must be overcome when lowering the window; however, this is accomplished generally without undue difficulties since the weight of the window complements the downward force applied by the user. Raising of the window sash, however, requires the user to overcome a force exceeding both the weight of the window plus the frictional force applied by the window positioner. Thus, this has been a severe detriment to the use of such window positioners often compelling the use of more complicated and expensive devices which are easier to operate.

It has also been found that such prior window positioners must be provided in a variety of different sizes and designs for windows of different widths, weights, and heights therefore requiring the manufacturer to provide a variety of such devices for use with the various window types. The attachment of such devices to the window and the jamb has in many cases also significantly increased the cost of the assembled window, particularly, when the positioning device forms an integral part of the window sash or jamb.

A significantly improved window sash positioner is disclosed in a commonly assigned U.S. Pat. No. 3,788,006, issued Jan. 29, 1974 entitled SELF-RELEASING FRICTIONAL WINDOW SASH BALANCE. The window positioning device disclosed therein is adapted to be mounted between a movable window sash and a window jamb to provide a relatively low frictional force between the sash and the jamb as the window is raised and an increased holding frictional force once the window is in a desired raised position. The window positioner disclosed therein is secured to the window sash and is positioned within a generally U-shaped jamb channel having a pair of side walls. The window sash is narrower than the jamb assembly so that the positioning devices may be mounted on each side of the window and extend into opposite sides of the jamb channel. During assembly, the positioning devices are first attached to the window and the window is installed in the jamb by shifting the window sash to one side and resiliently flexing a mounting bracket for the positioner such that the positioner clears the sides of the jamb and is shifted into the jamb channels.

Although the apparatus described in the abovementioned commonly assigned patent was a significant improvement in window sash positioner devices, it remains desirable to provide a window sash positioner which can be installed simply and conveniently after the window sash is installed in the supporting jamb framework.

SUMMARY OF THE INVENTION

The window sash positioner of the present invention is relatively simple in its construction and yet provides heretofore unavailable ease in use, both from the installation standpoint and in actual use when the window is raised and lowered. The frictional forces used to hold the window in place are automatically removed when the window is lifted thereby requiring the user to lift only the weight of the window itself. The positioner is adapted to be used with virtually any width and length of window and with windows in a variety of weights. The apparatus is easy to install by simply placing the window positioner on a rail formed within the window jamb and by attaching a connector to the top of the window sash. In a preferred embodiment of the invention, engaging portions of the positioner are formed of a relatively low friction material such that no lubrication is required. In addition, adjustment means is provided such that the frictional force applied by the positioner can be varied for use with windows of a different weight.

In a preferred embodiment of the invention, the positioner comprises an elongated housing member having a pair of cooperatively engaging members adjustably secured therein. A first member positioned in the housing is adapted to slidably engage a rail formed in the jamb channel. The first member has a shoe portion formed thereon adapted to frictionally engage one side of the rail. A second member slidably mounted with respect to the first has a surface formed thereon adapted to frictionally engage the opposite side of the rail. Biasing means in the housing and acting on the second member urge the latter toward the shoe portion of the first with the rail positioned therebetween to frictionally cooperatively hold the positioner on the rail during movement of the window toward a closed position. The second member, slidably mounted for movement with respect to the first, releases or substantially reduces the frictional holding of the second member with respect to the first with movement of the window toward an open position.

BRIEF DESCRIPTION OF THE DRAWINGS

The invention will now be described with reference to the accompanying drawings in which.

DETAILED DESCRIPTION OF THE INVENTION

Figure 1:
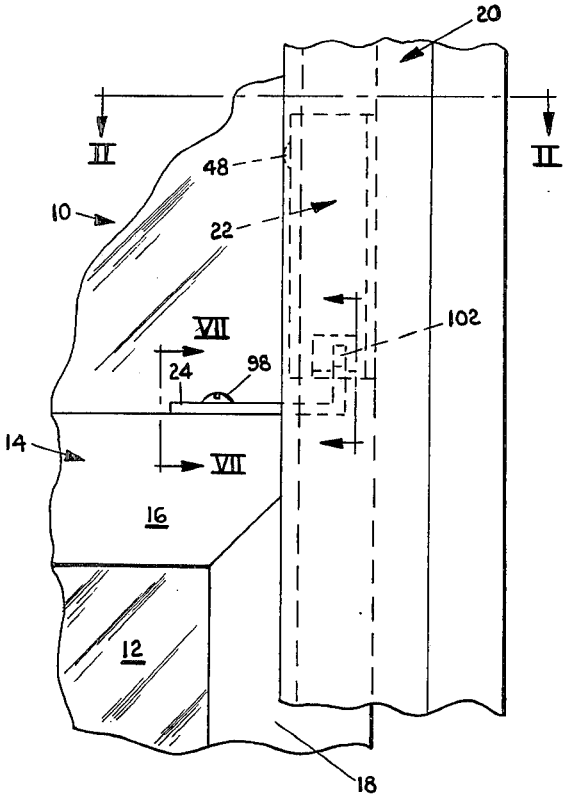
FIG. 1 is a fragmentary front elevational view of a window assembly employing the window positioning device of the present invention.
Figure 2:
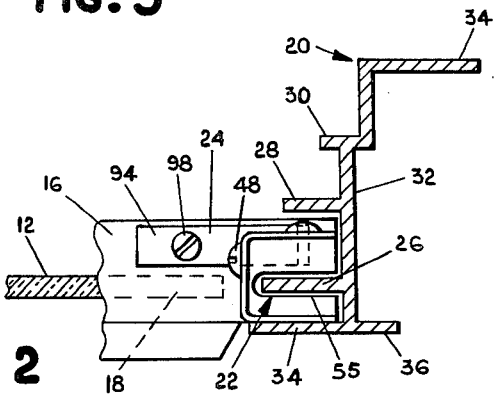
FIG. 2 is a cross-sectional view taken along the plane II—II of FIG. 1 illustrating the window jamb, the positioner, and a portion of the window sash.

Referring now to the drawings and in particular to FIGS. 1 and 2, a fragmentary view of a portion of a window assembly 10 is illustrated. A window pane 12 bordered by a sash 14 includes a top rail 16 and a pair of side rails 18 (only one side rail is shown, the opposite side being identical). Sash 14 is slidably mounted in window jamb channels 20. The window sash and jamb channels are equipped with at least one window positioner 22 secured to the top wall 16 of window sash 14 by means of a connector bracket 24. Preferably, two such window positioners are utilized, one on each side of the window. Since the positioners are identical in construction except that they are mirror images of each other for right and left hand use, only one will be described in detail.

The positioner extends into and engages a portion of jamb channel 20 to provide a bi-directional frictional force as will be described hereinafter such that a window sash can be easily raised and yet will reliably maintain its raised position.

Jamb channel 20 (FIG. 2) preferably is formed of an integral piece of extruded material as aluminum or plastic to include a plurality of integral ribs or rails 26, 28 and 30 extending outwardly from a main body portion 32. Preferably, the ribs or rails extend along the entire length of jamb channel 20. An inner wall flange 34 and an outer wall flange 36 form the inner and outer mounting surfaces for the window jamb framework in a wall. The side rails 18 of window sash 14 are correspondingly configured so as to be slidably received on rail 26 which serves as a guide for the window sash as it is raised and lowered. Side rail 18 extends between the inner wall flange 34 and centrally located rib or rail 28. The remaining rail 30 is positioned with respect to rail 28 and may be utilized to retain an upper window sash, screening, or the like (not shown).

Figure 3:
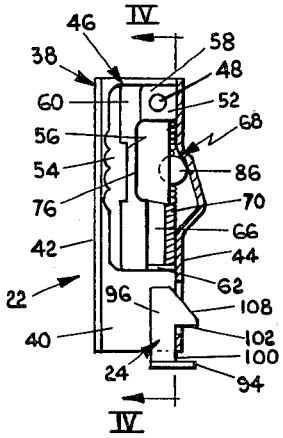
FIG. 3 is an elevational view of the window sash positioner of the invention, shown partly in section.
Figure 4:
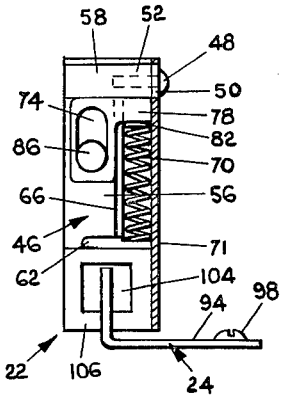
FIG. 4 is a cross-sectional view of the window sash positioner taken along the plane IV—IV of FIG. 3.
Figure 5:
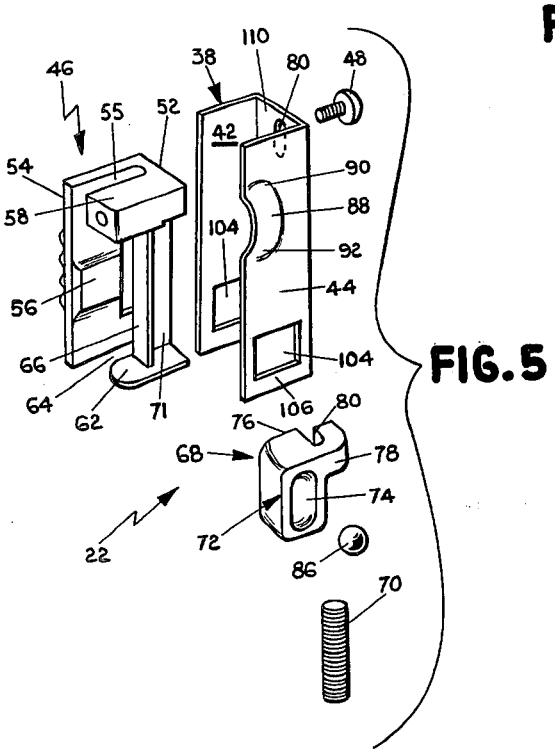
FIG. 5 is an exploded enlarged perspective view of the window sash positioner of the invention.

Positioner 22 shown in greater detail in FIGS. 3–7 is adapted to frictionally engage rail 26 to hole the window in a raised position. Referring to FIGS. 3, 4 and 5, positioner 22 includes an elongated generally U-shaped housing 38 which adjustably contains the component elements of the positioner. Housing 38 includes a base or bottom wall 40 and a pair of upwardly extending side walls 42 and 44.

The component elements of the positioner shown in greater detail in FIG. 5 are contained within housing 38 between walls 42 and 44. The component elements of the positioner include a first or fixed member 46 adjustably secured within housing 38 by means of an adjustment screw 48. Adjustment screw 48 passes through an elongated opening 50 in base wall 40 of the housing and into a base portion 52 of the fixed member for adjustment purposes as will be hereinafter described.

Fixed member 46 is preferably formed of a hard plastic material such as molded nylon or the like and includes an upwardly extending wall 54 which at one side abuts the inner side of wall 42. Wall 54 extends generally parallel along a portion of the length of housing 38. The opposite side of wall 54 is formed along its center portion to include a friction shoe surface 56 adapted to slide along and frictionally engage one side of the window jamb rail 26.

One end of the fixed member includes a post portion 58 extending perpendicular to base 52 and generally parallel to wall 54. Post 58 receives the threaded portion of screw 48 to adjustably retain the fixed member in housing 38. Post 58 is spaced from the first member wall 54 to form a gap or channel 55 to receive rail 26. The opposite or lower end of the first member includes an extending wall 62 having a similar gap or guide channel 64 formed thereon to also fit over and slide along window jamb rail 26. Post 58 and bottom wall 62 are separated from each other by an integral rail member 66 extending parallel to wall 54 and shoe surface 56. Integral rail 66 slidably supports a second or movable member 68 which forms an abutment mechanism to cooperatively frictionally engage the window jamb rail 26 with shoe 56. Integral rail 66 is formed in an L shape to extend a slight distance upwardly and outwardly from base portion 52 to provide a housing and retainer 71 for a bias spring 70 to be described hereinafter.

Movable member 68 is also formed of molded nylon or like material and comprises a generally rectangular housing 72 having an elongated cavity 74 formed therein. When assembled, the cavity open outwardly toward side wall 44 of housing 38. The inner facing surface of movable member 68 has a generally flat face surface 76 formed thereon slightly larger than the surface area of shoe 56 formed on the fixed member. Face surface 76 and shoe 56 cooperatively frictionally engage window jamb rail 26. (FIG. 6) to hold the window in desired open position.

Movable member 68 is formed with an outwardly extending arm 78 (FIG. 5) which includes a channel 80 adapted to be slidably received on integral rail 66 of fixed member 46. An abutment pad 82 (FIG. 4) formed on the lower surface of arm 78 extends outwardly from integral rail 66 and into spring housing 71. Bias spring 70 is positioned in housing 71 and extends between abutment pad 82 and the inner surface of bottom wall 62 to normally bias the movable member upwardly along integral rail 66 and toward post 58.

Figure 6:
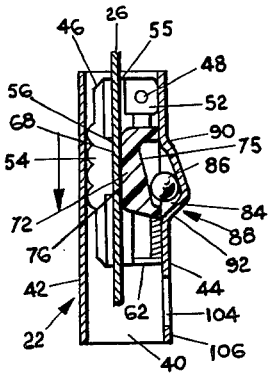
FIG. 6 is a framentary cross sectional view of a portion of the window positioner in a frictional engaging position with the window jamb rail as assumed when the window is held in a raised position.
Figure 7:
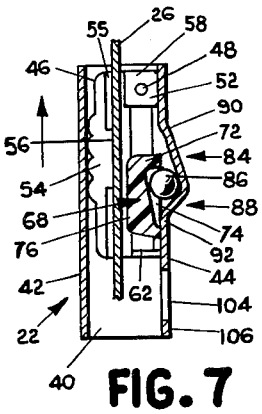
FIG. 7 is a fragmentary cross sectional view similar to FIG. 6 illustrating the operating components of the window sash positioner as the window is being moved from a closed to an open position.
Figure 8:
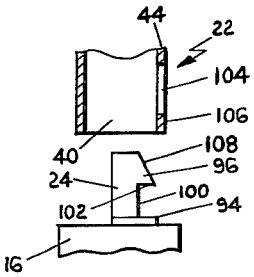
FIG. 8 is a fragmentary view illustrating the mounting mechanism for attaching the positioner to the sash frame.
Figure 9:
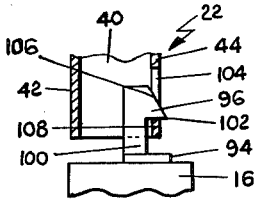
FIG. 9 is a view similar to FIG. 8 illustrating the positioner attached to the window sash.

Movable member 68 is urged laterally toward shoe 56, with varying degrees of force, upon movement of the movable member along integral rail 66, because of a camming mechanism 84 (FIGS. 6 and 7). Camming mechanism 84 includes a ball or other bearing element 86 and a tapered ramp or wedge surface 88 formed in, or on, side wall 44 of housing 38. In a preferred embodiment (illustrated in FIGS. 6 and 7) the tapered ramp 88 is formed within side wall 44 by means of a stamped dimple or depression which forms a tapered channel extending along a portion of the length of the housing side wall. Also, the elongated cavity 74 in movable member 68 is preferably inclined to form a coacting complementary wedge surface 75, as illustrated. The tapered ramps or wedge surfaces 75 and 88 cooperatively operate with bearing element 86 which is retained in cavity 74 of the movable member to force the movable member toward and away relative to shoe surface 56, and jamb rail 76 disposed there between, as a result of relative movement of the moveable member along the length of the integral rail 66 on the fixed member. As illustrated in FIGS. 6 and 7, channel 88 is formed directly in side wall 44 and tapers outwardly from a shallow point 90 at the upper portion of the housing, to have its greatest depth (with respect to the inner surface of wall 44) at a point 92. Bearing element 86 is retained within cavity 74 of movable member 68 and additionally in the channel 88 formed in side wall 44. Cavity 74 in the movable member extends lengthwise along the movable member and corresponds generally to the length of tapered channel 88 formed in the side wall of the housing. Also, as noted above, the floor 75 of this cavity preferably forms an inclined surface which is at a similar but slightly different, angle to the jamb rail than that of channel 88. With this arrangement, when the movable member is in the position illustrated in FIG. 6, the bearing element 86 has moved along the two complementary tapered wedging channels, to a point near the low point 90 of ramp 88 in the side wall 44 and near the high point of ramp surface 75, toward the left as viewed in the figures and tightly against the jamb rail 26, whose opposite side is engaged by the shoe 56. This is effect locks the positioner to the jamb rail, thereby holding the window sash firmly in position.

With reference to FIG. 7, which is greatly exaggerated to better illustrate the operation of moveable member 68 and the elements associated therewith, as the window carrying the positioner device 22 is moved upwardly into an open position, the window moves the positioner housing 38 with it, upwardly. At the same time, frictional contact between the face 76 of the movable member and rail 26, balanced against the loading of bias spring 70 and the effect of the camming mechanism 84, allows the movable member to shift very slightly toward the right as the bearing element 86 moves into a deeper part of the tapered channel, since a dynamic force balance then exists between the spring and the frictional forces, reducing the effective frictional force action upon the jamb rail and providing for easy upward movement of the window and positioner. Actually, the extent of the relative movement between movable member 68 and the remainder of the positioner device is very slight, and in actual operation the movable member would not move the extent shown in FIG. 7, which shows an open clearance between friction surface 76 of the movable member and the side of jamb rail 26. As stated above, this is an exaggerated showing to illustrate the overall operation; in normal operation no such clearance would exist, since only a slight shifting sufficient to ease the applied force is all that is necessary, the spring 70 always maintaining at least some light frictional contact between the movable member and the jamb rail.

Once the window is raised to the desired height and released, the weight of the window causes it to initially drop slightly downwardly, carrying the positioner housing 38 and fixed member 46 with it. During this brief movement, the movable member 68 remains generally in place with its face 76 bearing lightly against one side of rail 26, because of bias spring 70 whose compressive loading causes it to extend lengthwise while continuing to apply upward force against member 68. This results in relative movement of bearing element 86 along inclined surfaces 75 and 88 is superior to that which would result from only one such surface.

The positioning device 22 may be conveniently adjusted to vary the applied frictional force by loosening the adjusting screw 48 and sliding the fixed member 48 slightly vertically with respect to housing 38. The limit of vertical adjustment of the fixed member is determined by the elongated openin 50 formed in wall 40 of the housing. Shifting of the fixed member 48 with respect to housing 38 changes the highest allowable vertical position of the movable member along the tapered channel or ramp 88, and thus effectively controls the amount of force exerted on the movable member by the camming operation of the ramp. With vertical adjustment, the movable member is urged more or less toward and away from rail 26. Upward adjustment of the fixed member with respect to the housing will increase the resulting frictional holding force, since this causes bearing 86 to be positioned more toward the lower portion 90 of channel 88. Downward adjustment of the fixed member with respect to the housing will provide for decreased frictional force, as bearing element 86 is positioned more toward the deeper portion 92 of channel 88. In operation, the window is lowered in the customary way, i.e., by applying downward force to the sash. Since it is only necessary that sufficient frictional holding force be selected by making the adjustments mentioned above to overcome the weight of the window, only a slight additional downward force is necessary to close the window by manually pushing it downward, at which time the shoe 56 and force 76 of movable member 68 slide frictionally along on rail 26. As the window is raised, as previously mentioned, the frictional biasing forces are released and the window may be easily moved upwardly by lifting essentially only the weight of the window itself. Very little effort is required to lower the window.

Installation of the positioner may be simply accomplished in accordance with a preferred embodiment of the invention through the utilization of the bracket 24 shown in FIGS. 1, 3, 4, 8 and 9. Mounting bracket 24 is generally L-shaped in configuration having a first leg portion 94 and an upwardly extending second leg portion 96. Leg 94 is secured to the top of window 14 by means of a screw 98 threaded into top rail 16 of the sash. Leg 96 has a portion 100 cut away to form a hook-like end 102 thereon. The side walls 42 and 44 of the positioner housing 38 include openings 104 formed therethrough near the lower end of the walls (see FIG. 5). Openings 104 include a bottom wall surface in walls 42 and 44 forming rails 106 which are adapted for engagement with hook 102 on bracket 24. To install the positioner on a window assembly (FIGS. 8 and 9), the positioner 22 is first inserted within the jamb channels above the window sash, with the fixed and movable members straddling the rail 26. The mounting bracket 24 is secured to the top rail 16 of the sash by screw 98. As the window is raised for the first time, the tapered end 108 at end 96 of bracket 24 enters the positioner between walls 42 and 44 (which are slightly resiliently deformable) until hook portion 102 passes over rail 106. Rail 106 snaps into place below hook 102 and into the cutaway portion 100 of the bracket. The positioner is then operatively connected for movement with the window sash, since the hook 102 will pull the positioner down when the window is moved down, while the top of the mounting backet leg 94 pushes the positioner up when the window is raised, with accompanying operation of the positioner in the manner previously described. Adjustment of the window positioner may be conveniently made at any time with the sash and position installed in operative position, as described hereinabove, by loosening screw 48 (which is accessible within the jamb channel) and shifting the internal components of the positioner with respect to the housing to provide a holding force which fits the requirements of the particular window.

Although the foregoing description refers generally to a single window positioner and in some installations only one is required, it is generally preferred that two such window positioners be utilized, one on each side of the window frame.

It is entirely conceivable that upon examining the foregoing disclosure those skilled in the art may devise embodiments of the concept involved which differs somewhat from the embodiments shown and described herein or may make various changes in structural details to the present embodiment. Consequently, all such changed embodiments or variations in structure which utilize the concept of the invention and clearly incorporate the spirit thereof are to be considered as within the scope of the claims appended herebelow unless these claims, by their language, specifically state otherwise.

The embodiments of the invention in which an exclusive property or priviledge is claimed are defined as follows:

1. A window positioner device for a vertically slidable window sash and an associated window jamb of the type having a rail with exposed sides extending vertically along at least a portion of the length of said jamb; said positioner providing relatively low frictional force upon said jamb as the window is raised and increased frictional force sufficient to hold the window in a desired raised position while the window is at rest, said positioner comprising: an outer housing member; a first member positioned in said housing and having a shoe portion adapted to frictionally and slidably engage one side of said jamb rail; a second member in said housing movably mounted with respect to said first member, said second member having a surface adapted to frictionally engage the opposite side of said rail; urging means for acting in response to the downward gravitational force produced by the weight of the window sash to urge said second member toward said shoe portion and into cooperative frictional engagement with said rail sufficient to hold the sash in place against its own weight; means mounting said second member for movement with respect to said first member and to said urging means in response to upward movement of the window sash, for thereupon decreasing the frictional engagement holding said second member with respect to said rail; and means for biasing said movably mounted second member into a first position, said urging means including cam means positioned between said housing and said second member, said cam means forcing said second member toward said shoe portion when said second member is in said first position.

2. The positioner of claim 1 wherein said cam means includes releasing means for acting in response to movement of said second member away from said first position and toward a second position to decrease the force applied to said second member which urges the latter toward said shoe portion.

3. The positioner of claim 2 wherein said cam means includes a ramp means on at least one of said second member and said housing, and cam follower means between said second member and said housing, said ramp means and said follower means cooperatively operating to force said second member toward and away from said shoe upon movement of said second member between said first and said second positions.

4. The positioner of claim 3 wherein said ramp means is formed by part of said housing and said follower means is carried by said second member.

5. The positioner of claim 4 wherein said follower means comprises bearing means retained at least partially by said second member, said ramp means including a channel formed in said housing, said channel being formed to extend along a portion of the length of said housing parallel to the direction of movement of said movably mounted second member, the depth of said channel gradually increasing along its length a minimum depth adjacent said second position, said bearing means extending into and bearing against said channel to apply varying force to said second member relative to said shoe portion in response to movement of said second member between said first and said second positions.

6. The positioner of claim 5 and further including means for adjusting the allowable relative movement of said second member with respect to said shoe portion to thereby limit the frictional force applied between said second member and said shoe portion.

7. The positioner of claim 6 wherein said adjusting includes means for shifting said first member with respect to said housing to thereby vary the relative position of said channel with respect to said bearing means and said second member.

8. The positioner of claim 2 and further including means for attaching said positioner to a window sash, said attaching means including a clip member adapted for securement to the sash and having an engaging portion formed thereon, said housing member having cooperative engaging means thereon adapted to interengage with said engaging means on said clip member.

9. The positioner of claim 2 wherein said first and said second members are formed of lubricous material.

10. The positioner of claim 2, wherein said cam means includes a ramp means on both said housing and said second member, and cam follower means disposed between such ramp means.

11. The positioner of claim 10, wherein said cam follower means includes a rollable element disposed to contact both said ramp means.

12. The positioner of claim 11, wherein said rollable element comprises a ball member.

13. The positioner of claim 10, wherein said ramp means comprise mutually spaced and similarly inclined surfaces on both said housing and said second member.

14. The positioner of claim 13, wherein said similar inclined surfaces are each disposed it a shallow acute angle relative to said jamb rail.

15. A window positioner device for a vertically slidable window sash and an associated window jamb of the type having a rail with exposed sides extending vertically along at least a portion of the length of said jamb, said positioner providing relatively low frictional force upon said jamb as the window is raised and increased frictional force sufficient to hold the window in a desired raised position while the window is at rest, said positioner comprising: an outer housing member; a first member position in said housing and having a shoe portion adapted to frictionally and slidably engage one side of said jamb rail; a second member in said housing movably mounted with respect to said first member, said second member having a surface adapted to frictionally engage the opposite side of said rail; urging means for acting in response to the downward gravitational force produced by the weight of the window sash to urge said second member toward said shoe portion and into cooperative frictional engagement with said rail sufficient to hold the sash in place against its own weight; means mounting said second member for movement with respect to said first member and to said urging means in response to upward movement of the window sash, for thereupon decreasing the frictional engagement holding said second member with respect to said rail; said housing including a generally rigid portion having a pair of mutually spaced generally parallel walls and an interconnecting wall therebetween, one of said walls in said pair disposed laterally outside of and supporting said shoe portion of said first member and the other wall in said pair disposed laterally outside of and supporting said second member, said jamb rail located between said mutually spaced walls and between said shoe portion and said second member, said urging means acting on said other wall in said pair by applying outwardly-directed force thereto when urging said second member into frictional holding engagement with said rail.

16. The positioner of claim 15, wherein said urging means includes an angularly-disposed inclined surface on said other wall and follower apparatus movable along such surface.

17. The positioner of claim 16, wherein said inclined surface comprises an integrally formed deformation in said outer wall.

18. The positioner of claim 17 wherein said deformation comprises a stamped recessed portion.

19. The positioner of claim 16 including a resilient biasing member urging said follower apparatus in one direction along said inclined surface.

20. The positioner of claim 19 wherein said follower apparatus includes a member slidably retained upon said first member.

21. The positioner of claim 20 wherein said biasing member acts between said first member and said slidably retained member.

22. A window positioner device for a movable window sash and an associated window jamb having side walls extending vertically along at least a portion of the length of the jamb, said positioner having means for frictionally engaging said walls to hold the window sash at desired positions of vertical adjustment along the jamb, said frictional engaging means serving to mount said positioner upon said jamb and to retain the same in place by the frictional engagement of said jamb walls; a mechanical catch and means for attaching same to said window sash, said catch having latching portions separate and independent from said positioner but disposed in alignment therewith and movable into contact therewith by relative movement of the window and positioner toward one another, said latching portions and said positioner having interconnect means for coupling the two together when the latch portions and positioner are brought into contact, such that the positioner is moved up or down along said jamb by the window and catch as the window is raised or lowered.

23. The positioner of claim 22 wherein said positioner includes receiver portions engageable with said catch portions by latching together, and at least one such portion being resiliently movable at least an extent sufficient to flexibly move over the other when manually pushed against the latter during latching engagement.

* * * * *